US008191538B2

(12) United States Patent
Braun et al.

(10) Patent No.: US 8,191,538 B2
(45) Date of Patent: Jun. 5, 2012

(54) DEAERATING AND AERATING DEVICE FOR A SUPERCHARGED INTERNAL COMBUSTION ENGINE

(75) Inventors: Mirko Braun, Calw (DE); Robert Dunsch, Vaihingen (DE); Stefan Ruppel, Mannheim (DE); Yakup Ozkaya, Kornwestheim (DE)

(73) Assignee: Mahle International GmbH (DE)

( * ) Notice: Subject to any disclaimer, the term of this patent is extended or adjusted under 35 U.S.C. 154(b) by 678 days.

(21) Appl. No.: 12/298,193

(22) PCT Filed: Apr. 19, 2007

(86) PCT No.: PCT/EP2007/053818

§ 371 (c)(1), (2), (4) Date: May 7, 2009

(87) PCT Pub. No.: WO2007/122172

PCT Pub. Date: Nov. 1, 2007

(65) Prior Publication Data

US 2010/0000499 A1 Jan. 7, 2010

(30) Foreign Application Priority Data

Apr. 25, 2006 (DE) ..... 10 2006 019 636

(51) Int. Cl.
*F02M 25/06* (2006.01)
*F02M 13/02* (2006.01)

(52) U.S. Cl. ..... 123/572

(58) Field of Classification Search ..... 123/572–574
See application file for complete search history.

(56) References Cited

U.S. PATENT DOCUMENTS

| | | | | |
|---|---|---|---|---|
| 4,901,703 | A | 2/1990 | Humphries | |
| 6,405,721 | B1 | 6/2002 | Moren | |
| 2003/0106543 | A1 | 6/2003 | Gschwindt et al. | |
| 2008/0083399 | A1 * | 4/2008 | Hirano et al. | 123/572 |

FOREIGN PATENT DOCUMENTS

| | | |
|---|---|---|
| DE | 60020948 | 1/2005 |
| DE | 202004011882 | 1/2006 |
| EP | 0220886 | 12/1990 |
| EP | 1310639 | 9/2002 |
| JP | 62117212 | 5/1987 |
| JP | 04028877 | 1/1992 |
| JP | 2004060475 A | 2/2004 |
| WO | WO-00/61924 | 10/2000 |

OTHER PUBLICATIONS

English abstract for JP-2004060475. English abstract for JP-04028877.
Japanese Office Action issued May 31, 2011.
English abstract for DE202004011882.

* cited by examiner

*Primary Examiner* — M. McMahon
(74) *Attorney, Agent, or Firm* — Rader, Fishman & Grauer PLLC

(57) ABSTRACT

The present invention relates to a deaerating and aerating device (19) for an internal combustion engine (1) for discharging blowby gas out of a crankcase (3), comprising a first line (20) which is connected at one end to the crankcase (3) and at the other end to a fresh gas line (7) downstream of a supercharging device (10) and which contains a deaerating valve (23), and a second line (21) which is connected at one end to the fresh gas line (7) upstream of the supercharging device (10) and at the other end to the crankcase (3) and which contains a throttle device (28) and, parallel thereto, a non-return check valve (29) which provides a blocking action in the direction of the crankcase (3).

20 Claims, 3 Drawing Sheets

DEAERATING AND AERATING DEVICE FOR A SUPERCHARGED INTERNAL COMBUSTION ENGINE

CROSS-REFERENCES TO RELATED APPLICATION

Figure 1:
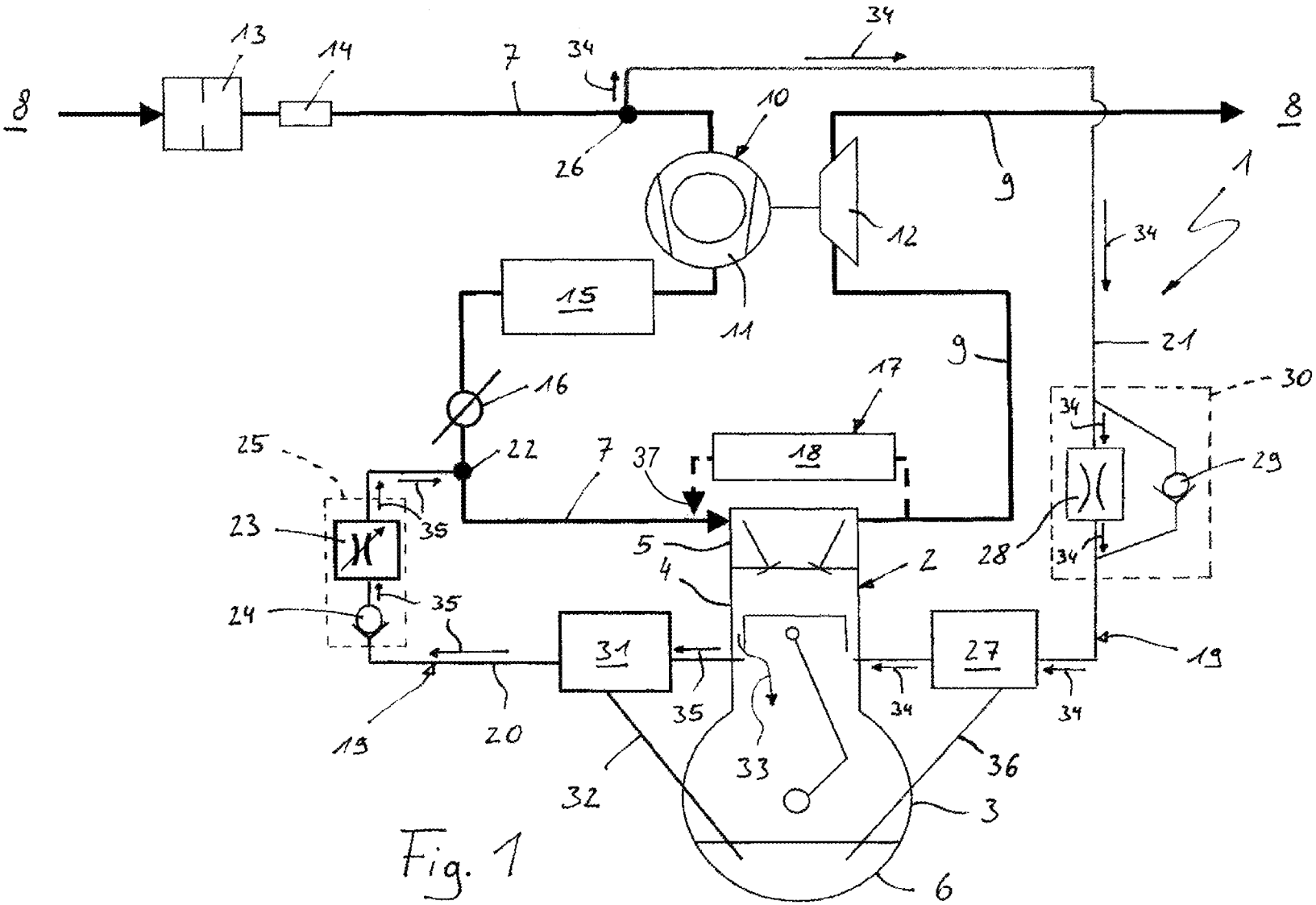

This is a National Stage application which claims the benefit of International Application No. PCT/DE2007/053818 filed Apr. 19, 2007, which claims priority based on German Patent Application No. DE 10 2006 019 636.8, filed Apr. 25, 2006, both of which are hereby incorporated by reference in their entirety.

The present invention relates to a deaerating and aerating device for a supercharged internal combustion engine, in particular in a motor vehicle for discharging blow-by gas from a crankcase of the internal combustion engine.

In internal combustion engines which are designed as piston engines, so-called blow-by gases from combustion chambers of the internal combustion engine enter a crankcase of the internal combustion engine during operation. The quantity of blow-by gases thereby generated depends on the operating state of the internal combustion engine, e.g., idling or full load. To prevent an unacceptably high excess pressure in the crankcase, the blow-by gases must be discharged from the crankcase. Emission of the blow-by gases into the environment is unwanted for environmental protection reasons.

Accordingly, a deaerating device usually includes a line, which is connected to the crankcase at one end and to a fresh gas line of the internal combustion engine at the other end. The blow-by gases are thereby supplied back to the internal combustion engine for combustion again. To be able to prevent emission of blow-by gases into the environment, it is expedient to exhaust the blow-by gases out of the crankcase in such a way that a vacuum is established in the crankcase. Such a vacuum is usually available in the fresh air line, at least in aspirated engines, in particular downstream from a throttle valve. However, in certain operating states, a vacuum so great that it can lead to destruction of the crankcase may develop in the fresh gas line. With the help of vacuum regulating valves, an attempt is made to adjust the vacuum in the crankcase at a predetermined level.

In supercharged internal combustion engines, there are additional problems due to the fact that introduction of blow-by gases downstream from the respective supercharging device is undesirable per se to prevent soiling of same. However, a sufficient vacuum is available on the pressure side of the supercharging device only when the internal combustion engine is operated in idling mode or in a lower partial load range.

A deaerating device preferably includes a first line, which is connected at one end to the crankcase and to the fresh gas line at the other end downstream from the supercharging device. The first line contains a deaerating valve, usually a vacuum regulating valve, which is designed so that, beyond a predetermined limit value of a pressure difference applied the valve, it limits the volume flow leading to the fresh gas line to a predetermined target value. An aerating and deaerating device may usually also have a second line, which is connected to the fresh gas line at one end upstream from the supercharging device and is also connected to the crankcase at the other end. This second line contains a throttle device, which is designed so that at a predetermined value of a pressure difference applied to the throttle, it adjusts a volume flow leading to the crankcase at a predetermined target value.

In idling operation of the internal combustion engine, a relatively great vacuum prevails at the connection point between the first line and the fresh gas line, in particular when it is downstream from a throttle valve, so that a relatively large amount of blow-by gas can be discharged out of the crankcase. However, only a comparatively small amount of blow-by gas is formed in idling operation. The second line allows aeration of the crankcase for this operating case by supplying fresh air intake to the crankcase upstream from the supercharging device to prevent an unacceptably great vacuum in the crankcase.

With an increase in partial load, the vacuum at the connection point of the first line drops while at the same time the amount of blow-by gas to be dissipated in the crankcase increases. Accordingly, the amount of fresh air supplied through the second line decreases. Above a certain partial load, the vacuum prevailing at the connection point of the first line is no longer sufficient to adjust the desired vacuum in the crankcase. The vacuum at the connection point of the first line becomes smaller than the vacuum at the connection point of the second line. Consequently, the direction of flow in the second line is reversed, so that it now ensures deaeration of the crankcase. The first line may expediently be equipped with a nonreturn cutoff device, so that the first line is cut off automatically in the direction toward the crankcase when the pressure in the fresh gas line at the connection point of the first line increases further.

With a further increase in partial load or at full load, excess pressure prevails in the fresh gas line downstream from the supercharging device. The first line is then cut off and the blow-by gases are discharged exclusively through the second line.

In certain operating states of the internal combustion engine, in particular at full load, the vacuum available in the fresh gas line upstream from the supercharging device is comparatively low, so that adequate exhausting of the blow-by gases is not always ensured. The problems become intensified in particular when the connection point of the second line must be positioned comparatively close to the inlet of the charging device, e.g., for reasons of installation space.

The present invention relates to the problem of providing an improved embodiment for a deaerating device of the type defined in the introduction, such that it is characterized in particular in that it allows a sufficient deaeration even at a comparatively low vacuum, so that it offers comparatively flexible connection options on the side of the fresh gas line.

This problem is solved according to the present invention by the subject matter of the independent claim. Advantageous embodiments are the subject matter of the dependent claims.

The invention is based on the general idea of arranging a nonreturn cutoff valve in the second line parallel to the throttle device, cutting off flow to the crankcase. What this achieves is that in deaerating the crankcase through the second line, the blow-by gases need not flow through the throttle device but instead can flow through the nonreturn cutoff valve opening in this direction. The flow resistance can therefore be reduced in this direction of flow, so that even a relatively minor vacuum is sufficient to adequately exhaust the blow-by gas. As a result, the second line may also be connected to such locations in the fresh gas line, where only a comparatively minor vacuum can be available, which improves flexibility in installation of the aerating and deaerating device.

Other important features and advantages of the invention are derived from the subordinate claims, the drawings and the respective description of figures on the basis of the drawings.

It is self-evident that the features mentioned above and those yet to be explained below may be used not only in the particular combination given but also in other combinations or alone without going beyond the scope of the present invention.

Preferred exemplary embodiments of the invention are depicted in the drawings and explained in greater detail in the following description, where the same reference numerals refer to the same or similar or functionally similar components.

Figure 2:
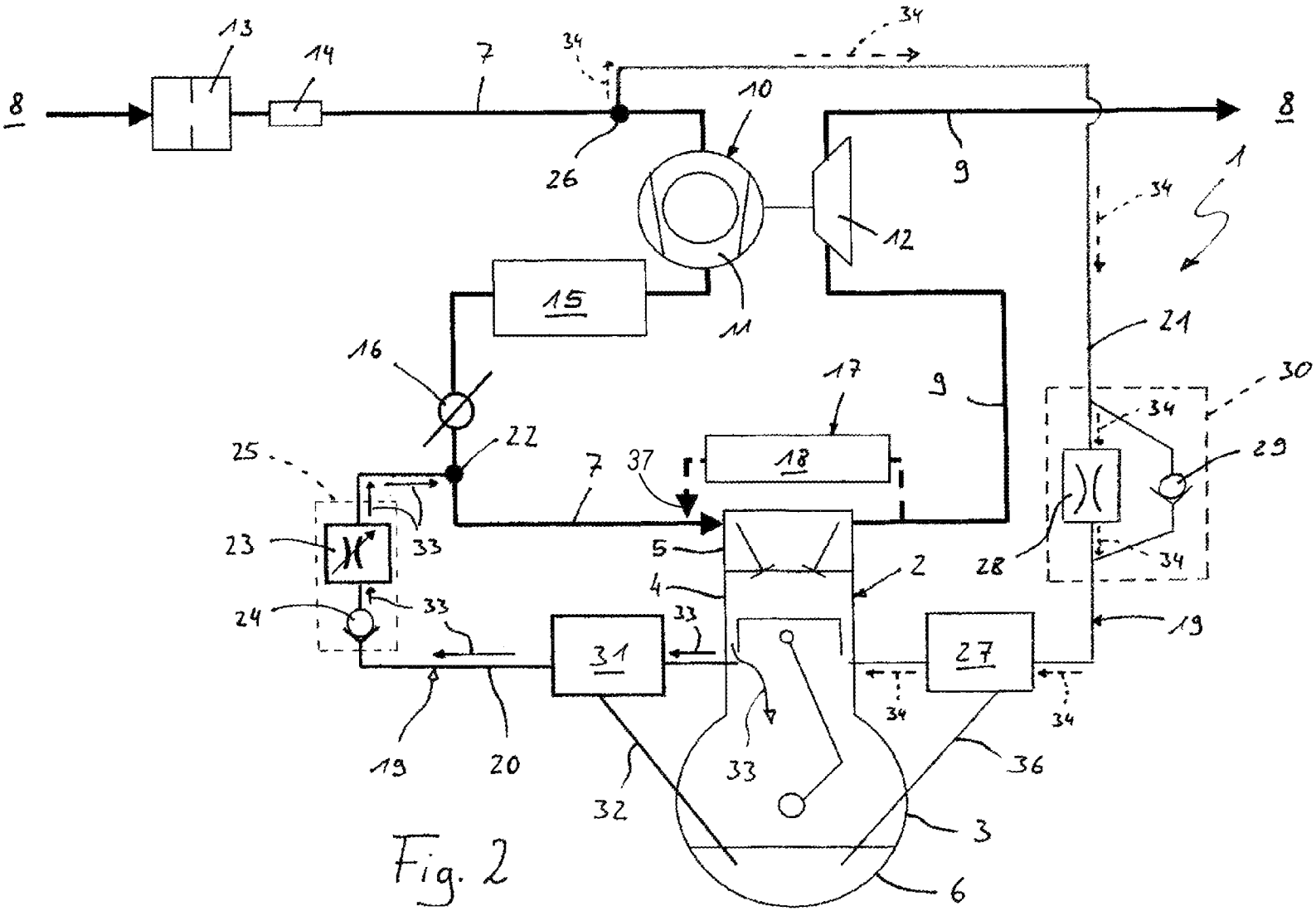
Figure 3:
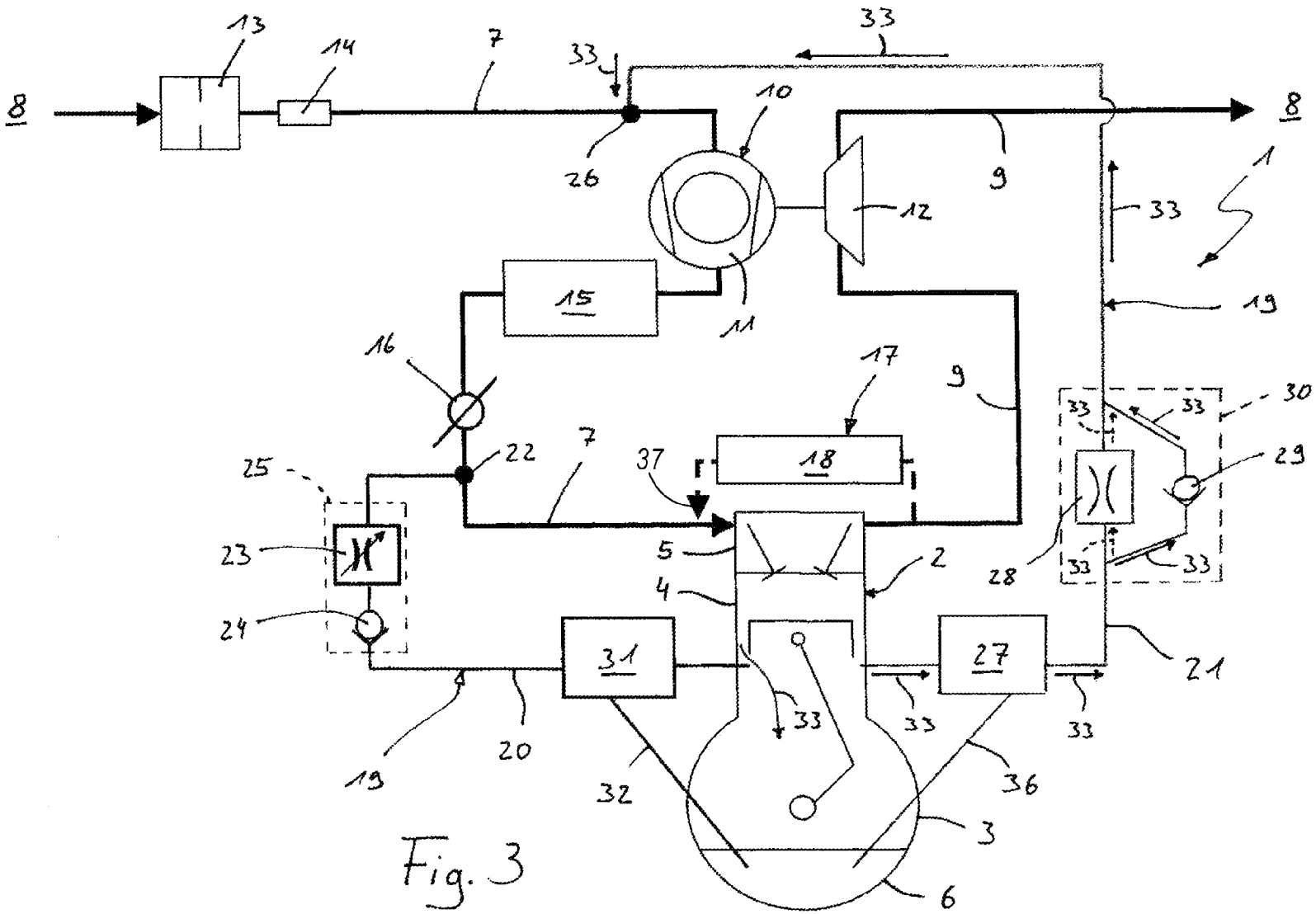

The drawings show schematically:

FIGS. 1 to 3 each show a greatly simplified basic diagram like a wiring diagram of a deaerating device in different operating states.

According to FIGS. 1 to 3, an internal combustion engine 1 comprises an engine block 2 having crankcase 3, cylinder head 4, rocker cover 5 and/or oil pan 6. A fresh gas line 7 carries fresh gas out of environment 8 to the engine block 2, while an exhaust line 9 discharges exhaust gas from the internal combustion engine 1 out of the engine block 2 and emits it into environment 8.

The internal combustion engine 1 is preferably installed in a motor vehicle. The internal combustion engine 1 is supercharged and accordingly has a supercharging device 10, which in the present case is designed as an exhaust gas turbocharger, for example. Accordingly, the supercharging device 10 comprises a compressor 11, which is installed in the fresh gas line 7, as well as a turbine 12 which is installed in the exhaust gas line 9. It is clear that the internal combustion engine 1 may also be equipped with another supercharging device 10, e.g., a mechanical supercharger, in particular a Roots blower.

At the inlet end, the fresh gas line 7 contains an air filter 13 and, downstream from that, an air mass flow measuring device or air flow meter 14, which is designed as a hot-film meter, for example. Downstream from the supercharging device 10, the fresh gas line 7 contains a supercharging air cooler 15 and, downstream from that, a throttle valve 16.

In addition, the internal combustion engine 1 is equipped with an exhaust gas recirculation device 17, which is shown here in a simplified diagram, where it is represented only by an exhaust recirculation cooler 18.

Furthermore, the internal combustion engine 1 is equipped with an aerating and deaerating device 19, with the help of which blow-by gas can be discharged from the crankcase 3 during operation of the internal combustion engine 1. Such blow-by gas enters the crankcase 3 during operation of the internal combustion engine 1 because of leakage from cylinder spaces in the engine block 2, which are not identified further.

The aerating and deaerating device 19 comprises a first line 20 and a second line 21. The first line 20 is connected at one end to the crankcase 3 and at the other end to the fresh gas line 7 via a first connection point 22. The first connection point 22 is located downstream from the supercharging device 10 and in particular upstream from the throttle valve 16. At the same time, the first connection point 22 is positioned within the fresh gas line 7 upstream from an inlet point 37 in the exhaust gas recirculation device 17.

With the examples shown here, a nonreturn cutoff device 24 is also arranged in the first line 20, cutting off the flow in the direction of the crankcase 3 and being operative in the direction toward the deaerating valve 23. The nonreturn cutoff device 24 is preferably integrated into the deaerating valve 23, resulting in a uniform module 25, which is formed by a deaerating valve with an integrated nonreturn cutoff function.

At one end, the second line 21 is connected to a second connection point 26, which is located upstream from the supercharging device 10, to which the fresh gas line 7 is connected, while at the other end it is likewise connected to the crankcase 3, preferably independently of the first line 20, and in particular directly.

The second line 21 contains a throttle device 28, which is designed so that it sets a volume flow leading to first line 20 at a predetermined target value for a predetermined value of a pressure difference applied to the throttle. Furthermore, the second line 21 is equipped with a nonreturn cutoff valve 29, which blocks in the direction of the first line 20. Nonreturn cutoff valve 29 and throttle device 28 are arranged so that flow can pass through them in parallel, so that the throttle device 28 forms a bypass which bypasses the nonreturn cutoff valve 29, which is also labeled as 28 below. The nonreturn cutoff valve 29 and the throttle device 28 may also form an integral component 30. This component 30 is formed in particular by the nonreturn cutoff valve 29 having the integrated bypass 28.

The first line 20 contains a first separator device 31, which is designed to remove oil and/or oil droplets from the blow-by gas exhausted out of the crankcase 3 during operation of the internal combustion engine 1. The separated oil can be recycled from the first separation device 31 back into the crankcase 3, preferably into the oil pan 6, through a first return line 32. In the preferred embodiment shown here, the second line 21 also contains its own second separator device 27 having a respective second oil return line 36.

The inventive deaerating device 19 operates as follows:

In a first operating state shown in FIG. 1, the internal combustion engine 1 is operating in idling operation, i.e., in an operating state of minimal load. In this operating state, comparatively little blow-by gas enters the crankcase 3. At the same time, the charging device 10 is essentially inactive; at least the throttle valve 16 causes a strong throttling, so that a comparatively great vacuum prevails in the fresh gas line 7 downstream from the throttle valve 16. This vacuum is so great that it is above the limit value of the deaerating valve 23 and above the predetermined value of the throttle device 28. Accordingly, the deaerating valve 23 allows the predetermined volume flow to pass through. The first line 20 produces deaeration of the crankcase 3. In this operating state, more gas can be discharged through the first line 20 than new blow-by gas flowing after it.

At the same time, a vacuum which is established at the second connection point 26 in the fresh gas line 7 is lower than the vacuum prevailing at the first connection point 22. The deaeration through the first line 20 lowers the pressure in the crankcase 3 until pressure-equalizing fresh gas can flow after through the second line 21. Subsequently, the throttle device 28 also allows a volume flow to pass through, this volume flow being smaller than the predetermined volume flow of the deaerating valve 23. The second line 21 causes aeration of the crankcase 3 with fresh gas out of the fresh gas line 21.

The deaerating valve 23 and the throttle device 28 are coordinated with one another in a targeted manner so that in this operating case, exactly enough fresh gas flows through the second line 21 into the crankcase 3 with a minimal amount of blow-by gas to be discharged out of the crankcase 3, so that a predetermined vacuum can be established in the crankcase 3. In particular the vacuum in the crankcase 3 should not drop indefinitely in this operating state. Accordingly, in this operating state the volume flow exhausted from the crankcase 3 via the first line 20 and discharged into the fresh gas line 7 is formed in part by the amount of blow-by gas to be discharged and otherwise by a corresponding amount of fresh gas, which is supplied to the crankcase 3 via the second line 21.

With an increase in the load of the internal combustion engine 1, the amount of blow-by gas produced in the crankcase 3 also increases so that more blow-by gas must be discharged accordingly. Because of the throttle effect of throttle device 28, the volume flow of the fresh gas supplied to the crankcase 3 also drops at the same time.

The blow-by gas flow is symbolized by arrows 33 in FIG. 1. The fresh gas flow is symbolized by arrows 34 in FIG. 1 and the flow of mixture comprising blow-by gas and fresh gas is symbolized by arrows 35 in FIG. 1.

FIG. 2 shows an operating state of the internal combustion engine 1 at partial load, at which only a comparatively small vacuum prevails at the first connection point 22 in the fresh gas line 7, but the vacuum is just great enough so that the total amount of the blow-by gas can still be discharged out of the crankcase 3 through the first line 20 and introduced into the fresh gas line 7. A deaerating valve 23, which is characterized by a characteristic line in which the volume flow passing through the deaerating valve 23 at first increases (linearly) and then reaches a maximum for the volume flow at a medium pressure difference and drops (linearly) with a further increase in the pressure difference down to a predetermined target value, which remains constant with a further increase in pressure difference, is suitable for this purpose. Said maximum is expediently in the range of a pressure difference, which is applied to the deaerating valve 23 in the operating state of internal combustion engine 1 illustrated in FIG. 2. In this operating state, the amount of fresh gas added to the blow-by gas through the second line 21 is very small and may even drop down to a value of zero. For illustration, the flow arrows for the fresh gas flow 34 are shown with interrupted lines.

Since the fresh gas flow 34 is more or less negligible in this operating state, there is more or less only the blow-by gas flow 33 in the first line 20 here.

With a further increase in load, in particular at full load, the state illustrated in FIG. 3 is established. First, the vacuum established at the first connection point 22 is too small to be able to exhaust the amount of blow-by gas generated. Secondly, an excess pressure may build up at the first connection point 22, in particular due to the activation or operation of the supercharging device 10 in combination with a corresponding throttle valve setting, thus making it impossible to introduce blow-by gas through the first connection point 22 into the fresh gas line 7. The nonreturn cutoff device 24 cuts off the flow at the first connection point 22 when there is an excess pressure.

With an increase in pressure on the pressure side of the supercharging device 10, the pressure on the intake side of the supercharging device 10 drops. Subsequently, a vacuum develops at the second connection point 26 sufficient to exhaust the blow-by gases produced in the crankcase 3 only through the second line 21. The second line 21 in this case produces the desired deaeration of the crankcase 3. This is fundamentally possible through the throttle device 28, which is indicated here by flow arrows, shown with interrupted lines. However, the nonreturn cutoff valve 29 opens in this direction of flow, so that the blow-by gas flow 33, at least most of it, flows through the nonreturn cutoff valve 29.

The nonreturn cutoff valve 29 is preferably designed so that its opening resistance and its flow-through resistance are lower than the flow-through resistance of the bypass and/or of the throttle device 28. In particular, the opening resistance and the flow-through resistance of the nonreturn cutoff valve 29 are selected so that the vacuum prevailing at the second connection point 26 is sufficient to exhaust the amount of blow-by gas produced in this operating state or state range out of the crankcase 3. In this way, a predetermined vacuum may be established in the crankcase 3. The second line 21 is more or less dethrottled in the opening direction of the nonreturn cutoff valve 29 due to the very low resistances for opening and flow through the nonreturn cutoff valve 29, so that a sufficient deaeration can be achieved even with a comparatively low vacuum, so that it is possible in particular to position the second connection point 26 relatively close to an inlet of the supercharging device 10.

The invention claimed is:

1. A deaerating and aerating device for a supercharged internal combustion engine, for discharging blow-by gas out of a crankcase of the internal combustion engine, comprising:

a first line, which is selectively connected to the crankcase at one end, and which is selectively connected at the other end downstream from a supercharging device of the internal combustion engine to a fresh gas line of the internal combustion engine, and which contains a deaerating valve that is designed so that beyond a predetermined limit value of a pressure difference applied thereto, it limits a volume flow leading to the fresh gas line to a predetermined target value; and a second line, which is selectively connected at one end upstream from the supercharging device to the fresh gas line which is selectively connected at the other end to the crankcase and which contains a throttle device designed, so that at a predetermined target value of a pressure difference applied thereto, it adjusts a volume flow leading to the crankcase;

wherein the second line contains parallel to the throttle device a non-return cutoff valve which blocks the flow from the fresh gas line to the crankcase, so that the throttle device forms a bypass that bypasses the non-return cutoff valve, and wherein an opening resistance and a flow-through resistance of the non-return cutoff valve are lower than a flow-through resistance of one of the bypass and the throttle device.

2. The deaerating and aerating device according to claim 1, wherein one of the bypass and the throttle device are integrated into the non-return cutoff valve.

3. The deaerating and aerating device according to claim 1, wherein the opening resistance and the flow-through resistance of the non-return cutoff valve are selected so that the vacuum prevailing at a connection point at which the second line is connected to the fresh gas line is sufficient in full-load operation of the internal combustion engine to adjust one of a predetermined vacuum in the crankcase and to exhaust a predetermined amount of blow-by gas.

4. The deaerating and aerating device according to claim 1, wherein the first line contains a non-return cutoff device, which cuts off the flow from the fresh gas line to a connection point.

5. The deaerating and aerating device according to claim 4, wherein the non-return cutoff device is integrated into the deaerating valve.

6. The deaerating and aerating device according to claim 1, wherein the deaerating valve and one of the bypass and the throttle device are coordinated with one another, so that in idling operation of the internal combustion engine one of the pressure drop in the crankcase is limited to a predetermined vacuum, and the blow-by gas exhausting from the crankcase is limited to a predetermined volume flow.

7. The deaerating and aerating device according to claim 1, wherein the first line is connected to the fresh gas line downstream from at least one of a supercharging air cooler, a throttle valve, and an introduction point of an exhaust gas recirculation device.

8. The deaerating and aerating device according to claim 1, wherein the second line is connected to the fresh gas line downstream from at least one of an air flow meter, and an air filter.

9. The deaerating and aerating device according to claim 1, further comprising a separator device for separating at least one of oil and oil droplets from the blow-by gas is provided in the first line and in the second line.

10. A deaerating and aerating device for a supercharged internal combustion engine, comprising:

a first line selectively connected to a crankcase at one end, and a fresh gas line at the other end, downstream from a supercharging device;

a deaerating valve configured in the fresh gas line, the deaerating valve being configured such that beyond a predetermined pressure difference limit value, the valve limits a volume flow leading to the fresh gas line to a predetermined target value; and a second line selectively connected to the fresh gas line at one end upstream from the supercharging device, and to the crankcase at the other end; and a throttle device contained within the second line, the throttle device being configured to adjust a volume flow leading to the crankcase at a predetermined target value of a pressure difference applied thereto;

wherein the second line contains a non-return cutoff valve generally parallel to the throttle device, the non-return cutoff valve blocks the flow from the fresh gas line to the crankcase, such that the throttle device forms a bypass that bypasses the non-return cutoff valve, and wherein an opening resistance and a flow-through resistance of the non-return cutoff valve are lower than a flow-through resistance of one of the bypass and the throttle device.

11. The deaerating and aerating device according to claim 10, wherein the opening resistance and the flow-through resistance of the non-return cutoff valve are selected so that the vacuum prevailing at a connection point at which the second line is connected to the fresh gas line is sufficient in full-load operation of the internal combustion engine to adjust one of a predetermined vacuum in the crankcase and to exhaust a predetermined amount of blow-by gas.

12. The deaerating and aerating device according to claim 10, wherein the first line contains a non-return cutoff device which cuts off the flow from the fresh gas line to a connection point.

13. The deaerating and aerating device according to claim 10, wherein the deaerating valve and one of the bypass and the throttle device are coordinated with one another, so that in idling operation of the internal combustion engine one of the pressure drop in the crankcase is limited to a predetermined vacuum, and the blow-by gas exhausting from the crankcase is limited to a predetermined volume flow.

14. The deaerating and aerating device according to claim 10, wherein the first line is connected to the fresh gas line downstream from a supercharging air cooler and a throttle valve.

15. The deaerating and aerating device according to claim 10, wherein the first line is connected to the fresh gas line downstream from a supercharging air cooler and an introduction point of an exhaust gas recirculation device.

16. The deaerating and aerating device according to claim 10, wherein the first line is connected to the fresh gas line downstream from a supercharging air cooler, a throttle valve, and an introduction point of an exhaust gas recirculation device.

17. The deaerating and aerating device according to claim 10, wherein the second line is connected to the fresh gas line downstream from at least one of an air flow meter and an air filter.

18. The deaerating and aerating device according to claim 10, further comprising a separator device for separating at least one of oil and oil droplets from the blow-by gas is provided in the first line and in the second line.

19. The deaerating and aerating device according to claim 10, wherein the second line is connected to the fresh gas line downstream from at least one of an air flow meter and an air filter.

20. The deaerating and aerating device according to claim 10, wherein one of the bypass and the throttle device are integrated into the non-return cutoff valve.

* * * * *